United States Patent [19]

Buchl

[11] Patent Number: 5,018,496

[45] Date of Patent: May 28, 1991

[54] METHOD AND APPARATUS FOR THROTTLE VALVE CONTROL IN INTERNAL COMBUSTION ENGINES

[75] Inventor: Josef Buchl, Lenting, Fed. Rep. of Germany

[73] Assignee: Audi AG, Ingolstadt, Fed. Rep. of Germany

[21] Appl. No.: 498,341

[22] Filed: Mar. 23, 1990

[30] Foreign Application Priority Data

Mar. 25, 1989 [EP] European Pat. Off. ..... 89105378.7

[51] Int. Cl.[5] ..... F02D 9/02; F02D 9/08

[52] U.S. Cl. ..... 123/399; 123/361

[58] Field of Search ..... 123/360, 361, 397, 398, 123/399

[56] References Cited

U.S. PATENT DOCUMENTS

| | | | |
|---|---|---|---|
| 4,785,782 | 11/1988 | Tanaka et al. | 123/399 |
| 4,860,708 | 8/1989 | Yamaguchi et al. | 123/399 |
| 4,879,657 | 11/1989 | Tamura et al. | 123/399 |

FOREIGN PATENT DOCUMENTS

| | | |
|---|---|---|
| 0208222 | 1/1987 | European Pat. Off. . |
| 3711779 | 10/1988 | Fed. Rep. of Germany . |
| 153945 | 1/1985 | Japan . |
| 167037 | 11/1988 | Japan . |

*Primary Examiner*—Tony M. Argenbright
*Assistant Examiner*—Robert E. Mates
*Attorney, Agent, or Firm*—Jacques M. Dulin; Thomas C. Feix

[57] ABSTRACT

Throttle valve assembly having a servomotor to control the closure of the throttle valve flap in the range of from 0° to about 4°-15° in accord with predetermined criteria. Wider opening is controlled by the driver actuating the gas pedal. Upon sudden release of the gas pedal, mechanical linkage permits the throttle flap to close to a preset opening in the range of approximately 4°-15°, and thereafter the servo permits delayed or timed closing to 0° (plus idle setting). A setting control unit is provided to permit a full range of idle control adjustments. The setting control unit also provides a solenoid stop in the event of failure of the servo motor, and also for cruise control setting. Desired value and actual throttle opening value transmitters provide signals to a microprocessor which integrates the information into control of the servo and the stop assembly solenoid. The servo also prevents stalling and hesitation upon rapid depressing of the gas pedal through preprogrammed opening of the throttle by means of the servo. The microprocessor can also control the throttle based on additional inputs from engine operating conditions, load conditions, wheel spin, angle slip, and the like, to provide optimum engine operation and fuel economy.

20 Claims, 1 Drawing Sheet

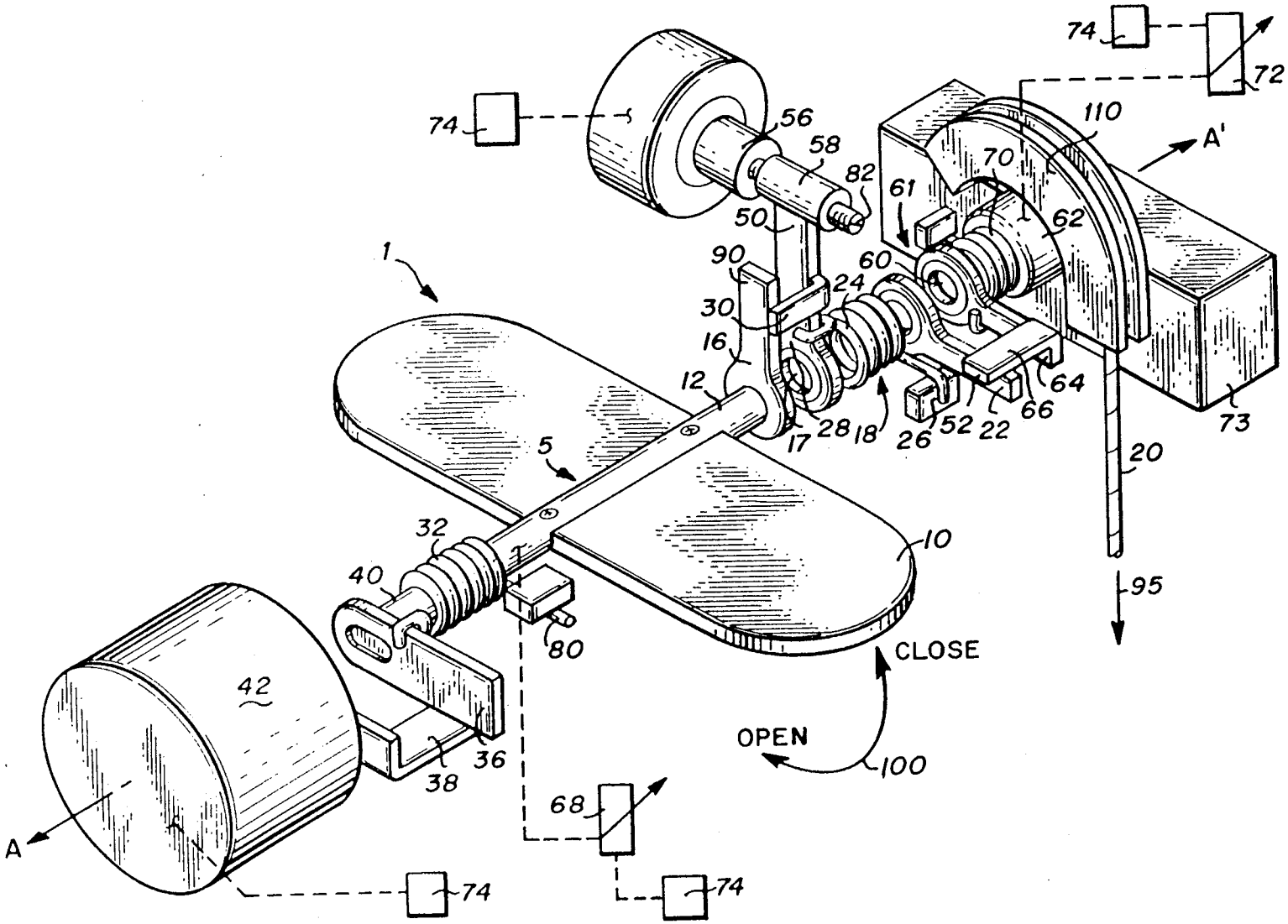
CLOSE
OPEN
A'
A

METHOD AND APPARATUS FOR THROTTLE VALVE CONTROL IN INTERNAL COMBUSTION ENGINES

The invention relates generally to a method and apparatus for controlling the operation of a throttle valve for use in internal combustion engines. More particularly the invention relates to a method and apparatus to control idle level fuel injection through fine tuning the mechanical operation of the throttle valve by using a servomotor controllable in response to actual setting value and desired setting value transmitters to limit the amount of throttle valve closure in response to a total release of pressure on the gas pedal.

BACKGROUND

An example of an internal Combustion engine having a throttle valve of the general type has been described in DE-OS No. 37 11 779. The throttle valve described therein is controlled by a conventional mechanical throttle linkage and an electronic servomotor. Electronic control of the gas pedal is achieved by using the servomotor to control the throttle valve operation between the phases of the completely closed position and the maximum open position. When the gas pedal is not being depressed, the mechanical throttle linkage will fully close the throttle valve. In the event of a failure of the servomotor, the throttle valve is still fully operable by the manual override capability of the mechanical throttle valve linkage.

However, this servomotor controlled throttle valve operation does not adequately control idle fuel injection. For instance, when the throttle valve is completely closed (i.e. during idle conditions), it is being controlled by the mechanical linkage rather than the servomotor. The engine does not respond quickly to a sudden depression of the gas pedal because of the slight delay inherent in the mechanical linkage involved in opening the throttle valve.

It is desirable to keep the throttle valve open a slight degree (preferably between 0°-10°) during idle conditions to ensure that the engine remains ready to move, and to allow the throttle valve to completely close when the engine is turned off.

Imprecise or inadequate control of the throttle valve usually results in a momentary stall during an acceleration from the idle condition. Thus, there is a definite need in the art to improve engine operating engine performance, and fuel efficiency through more precise control of throttle valve operation.

THE INVENTION

Objects

It is among the objects of the invention to provide methods and apparatus for the operation of a setting unit for a throttle valve of an internal combustion engine where the maximum opening angle of the throttle valve is preset mechanically and the smaller closure angles (typically in the range of 0°-10°) are controlled electronically.

Still other objects of the invention will be evident from the specification and drawings.

DRAWINGS

The invention is illustrated in more detail by reference to the drawing in which:

The FIGURE is an isometric view of the entire throttle valve control assembly showing the throttle valve in the closed position.

SUMMARY

An improved throttle valve assembly comprising three co-axially aligned but spaced sub-assemblies: the main throttle valve unit, a setting unit and a pivot unit. The main throttle valve has a rotatable spring-biased closure flap which is actuatable by a servo-motor for small closure angles of from 0° to about 4°-15° for idle control and at cruise control settings. The closure flap is also controllable by the driver for other ranges through a mechanical linkage from the gas pedal via the pivot unit and setting unit.

The setting unit includes a spring-biased lever with a tang that engages a lever on the throttle flap shaft. The setting unit spring has a greater spring force than the throttle valve unit to bias the flap toward the closed position. The setting unit also includes a solenoid stop adjuster with a set screw normally set to prevent mechanical linkage biasing of the throttle valve flap closed in ranges less than about 4°-15°. In the event of throttle valve unit servo failure the solenoid can move the stop to permit full closure.

The pivot unit is also spring biased and has a lever with a tang engaging a lever on the shaft of the setting unit. As the gas pedal is depressed, a cable rotates the pivot unit, which in turn rotates the setting unit shaft permitting the throttle valve flap to open under its spring pressure.

The pivot unit has a potentiometer-type desired value transmitter showing the rotational angle of the pivot unit shaft as a result of depressing the gas pedal. The throttle valve unit has an actual value transmitter which shows the actual angle of rotation of the throttle valve to provide a reading of the actual opening (in degrees) of the throttle valve flap. These transmitters provide inputs to a microprocessor which in turn controls the operation of the throttle valve servomotor and the setting unit solenoid.

This invention permits control of the closure of the throttle value for smoother and more efficient operation. The servo may be programmed for time delay or graduated slow closure from a setting of about 4°-15° to zero when the gas pedal is completely released. Initially the flap closes to 4°-15° by the mechanical linkage of the three sub-assemblies, and is then closed smoothly and more slowly to zero by the servo. This prevents lurching when the gas pedal is abruptly released.

Likewise the idle setting is easily adjusted. The servo also provides smooth opening so there is no hesitation upon abrupt depressing of the gas pedal. The solenoid adjustment of the stop point in case of failure of the servo is a valuable safety feature.

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

A throttle valve assembly constructed in accordance with the preferred embodiment of the present invention is indicated generally by the reference numeral 1 in the FIGURE. For purposes of this description, all references to the "North" or "top" end of the throttle valve assembly will refer to the region on the right of the FIGURE adjacent the pulley 110 and cable 20, see arrow A'. Similarly, the "South" or "bottom" end of the throttle valve assembly will refer to the region on the left, adjacent the servomotor 42, see arrow A.

In actual use, the A—A' axis would be oriented vertically when installed in the intake tube of an internal combustion engine, end A down. The throttle valve 10 is shown in the closed position. The throttle valve 10 is rigidly fixed to shaft 12. A rotation of shaft 12 in the downward direction of Arrow 100 (that is, the clockwise direction) will bring the throttle valve (10) into its "open" position.

The throttle valve assembly 1 generally comprises three distinct units including: A throttle valve unit 5, a setting unit 18, and a pivot unit 61. All units are coaxially aligned along axis A—A'. They are described in detail separately below.

THROTTLE VALVE UNIT

The throttle valve unit assembly comprises axial shaft 12 onto which the throttle valve flap 10 is rigidly fixed about its midsection. The axial shaft 12 is connected to a servomotor 42 by means of a lever and engaging tang linkage at its South/left (or bottom) end, the A end of the A-A' axis. Specifically, a radially extending lever 36 (shown approximately in the 3 o'clock position) is fixedly secured to the South end 40 of the shaft 12. The lever 36 moves in an arcuate path, much like a spoke on a wheel, in response to an axial rotation of shaft 12. An L-shaped tang member 38, being integral with the servomotor 42, is disposed to engage lever 36 to control the axial rotation of shaft 12 in the counter-clockwise direction. (i.e., to prevent the throttle valve 10 from completely closing during idle conditions). The axial rotation of shaft 12 in the opening direction (clockwise viewed from the South end) is biased spring 32 which is coiled about the Southern-most portion 40 of shaft 12. The North end of spring 32 abuts stop-point member 80, while the Southern end of spring 32 is constrained by lever 36.

Another radially extending lever 16 (shown in approximately the 12 o'clock position) is disposed at the North end of shaft 12 and is rigidly affixed thereto. The outboard free end 90 of lever 16 acts as a stopping-point member, and is adapted to engage a laterally extended force linkage or tang 30 associated with the setting unit assembly 18.

SETTING UNIT

What follows is the description of the setting unit assembly 18 of the throttle valve assembly 1. The setting unit is disposed intermediate the North end of the throttle valve unit 5 and the South end of the pivot unit 61. The shaft 17 of the setting unit 18 is positioned coaxially with the axis A-A' and has radially extending levers, including a drive lever 22 and an output lever 28, both of which are fixedly secured thereto.

As shown in the FIGURE, the output lever 28 is positioned at the Southern end of shaft 17 generally parallel (usually in the 12 o'clock position) to the lever 16 of shaft 12. It has a laterally extending tang member 30 that is adapted to engage the lever 16 at the outboard end stopping point 90. Proceeding along the length of output lever 28 radially outwardly from the axis of shaft 17 is lever extension 50 connected to the periphery of barrel end member 58.

The barrel end member 58 has a longitudinally extending threaded bore therethrough into which a stop screw 82 is inserted at one end. At the opposite end of the barrel end member 58 is disposed, a stop adjuster means 54 (which may be, for example, a hydraulic or pneumatic pressure box or a solenoid, with a solenoid being preferred) having an adjuster bolt 56 (e.g., the moveable center rod of the solenoid) to "push forward" or "release back" (advance or retract) the barrel end member 58 so that the limit position of the output lever 28 can be adjusted. The output lever 28 is biased counterclockwise by recoil spring 24, which is coiled about shaft 17. The opposite end of the spring coil abuts against a fixed point such as stop member 26 connected to the engine. This recoil spring 24 of the setting unit 18 is installed under a pretension force to move the throttle valve 10 into its closed position (i.e. forcing radial lever 16 in the counterclockwise direction) by moving the output lever 28 and lateral tang member 30 into engagement with lever 16 of shaft 12.

It is essential that the spring 32 has a smaller (weaker) spring force characteristic than the recoil (resetting) spring 24. Otherwise, the throttle valve would not move to the "closed" position when pressure is taken off the gas pedal. As shown in the FIGURE, spring 32 is disposed to exert a clockwise torque on the South end of shaft 12 because one end of the spring 32 is permanently biased against the motor or frame at stop point member 80. It should also be understood that the spring 32 could also directly link lever 36 with output lever 28.

The stop adjuster means 54 functions to limit the axial rotation of the setting unit 18 in the direction of the closed position of the throttle valve 10.

A principal difference between the prior art and the present invention is in the decoupling between the manual operation (operation by foot) and the electronic operation of the throttle in the present invention. The minimum degree of the manual operation is defined by the stop adjuster 54 so that under normal conditions the manual operation range is always more than about 4°-15° open, and the range between 0° and 10° is controlled and adjusted by the servo 42 controlled by microprocessor 74 (e.g. for stabile idle function). Under emergency conditions the throttle 10 is controlled manually, that is by foot control on the gas pedal, and the stop adjuster adjusts the minimum opening to the value less than 10° in order to have the idle setting controlled by the stop adjuster.

The stop adjuster 54 can move a bolt or similar member 56 by hydraulic, pneumatic or electric means (e.g. 54 is a solenoid and 56 is the bolt). This bolt 56 forms a stop surface for the end member 58 of lever 50, when the solenoid is actuated. The exact distance between the end 58 of lever 50 and the stop area on the front of the bolt 56 is adjusted by screw 82.

Under emergency conditions, e.g., if the servo 42 does not work, the bolt 56 is not activated (advanced) to the right by solenoid 54. Rather the solenoid retracts bolt 56 to the left in the drawing so that lever 50 can move further in a counterclockwise direction, permitting more or less full closure of the throttle flap 10.

At the northern end of the shaft 17, drive lever 22 is disposed to engage a lateral extending tang 66 associated with pivot unit 61. What follows is a description of the pivot unit 61.

PIVOT UNIT

The pivot unit 61 comprises a shaft 60 having a radially extending adjusting lever 64 fixed at its South end and a pulley 110 secured in bearing 62 disposed at its North end. Shaft 60 is journaled into bearing 62 secured to fixed element 73. The lever 64, being positioned substantially parallel to drive lever 22 of the setting unit 18, has laterally extending tang member 66 at its free end which is disposed to engage drive lever 22. The adjusting lever 64 is biased by a recoil spring 70. The pivot unit 61 is the primary method for setting the throttle valve 10. When the gas pedal (not shown) is depressed, the cable 20 moves in the direction of arrow 95. This rotates the pulley 110 and hub 62 in the clockwise direction. This causes the adjusting lever 64 and lateral tang member 66 to likewise rotate in the clockwise direction and thereby engage drive lever 22 of the setting unit 18, which in turn, causes the output lever 28 to move clockwise relieving pressure from tang 30 on lever 16. In turn, spring 32 causes rod 12 and lever 16 to follow. Hence, by this series of tang and lever linkages, the lever 16 also rotates clockwise, which moves the throttle valve 10 in the downward (clockwise) direction of arrow 100 (i.e., the open position).

The recoil spring 70 is provided to insure that when the gas pedal is not being depressed, the pivot unit 60 is reset at its zero position. This also takes up the slack (re-tensions) the loose cable 20 when it is at rest. A desired-value transmitter 72, e.g. a potentiometer, is used to electronically report the rotational angle of pivot unit 60, and hence the adjusting lever 64. Potentiometer 72 is rotated by hub 62 when the accelerator pedal is pressed down via cable 20 rotating pulley 110. The potentiometer delivers an electronic or resistance value corresponding to the degree of rotation of hub 62. These transmitted values are electronic signals that represent the driver's operation of the gas pedal which are translated into necessary power requirements for smooth acceleration and deceleration by the throttle value/microprocessor assemblies of this invention.

Another method for controlling the closure setting the throttle valve 10 is by using the servomotor 42. The servomotor 42 is governed by the vehicle's electronic microprocessor system 74 which receives signals associated with wheel spin, slip or angle for slip control, engine parameters, load, speed, etc. The electronic microprocessor logic serves to optimize fuel consumption by using the servomotor 42 to open or close the throttle valve according to predetermined parameters for optimum engine operation. The microprocessor electronic logic also factors-in power changes that may occur during a sudden opening of the throttle valve to dampen unwanted engine surge. Thus, the throttle valve is moved in the direction of its closed position (counterclockwise) in order to avoid undesirable operating conditions such as a sudden slip, an engine surge due to a rapid power change, or excessive fuel consumption. This is done by triggering the servomotor 42 (by an electronic signal sent by the microprocessor 74). This, in turn, operates shaft 40 via the tang and lever linkage of L-shaped tang member 38 and radial lever 36 to axially rotate in the counter-clockwise direction (i.e., the "close" position of arrow 100). Thus, the lever 16 with its corresponding stop point 90 is released from engagement with lateral tang 30 of the output lever 28 of the setting unit 18. Spring 32, being weaker than recoil spring 24 of the setting unit, is forced against its torque direction (clockwise rotational direction of spring force), and the throttle valve 10 is closed (i.e., moved in the counterclockwise direction) by the amount specified by the microprocessor control of rotation of servo 42.

An actual-value transmitter 68, e.g. a rotational angle sensor, preferably a potentiometer, is used to determine the actual degree of closure of the throttle valve 10 by measuring the degree of change in axial rotation of shaft 12. The value signal is sent to microprocessor 74. This angular value information is then used by the microprocessor electronic logic to generate a new desired-value setting for the desired value transmitter 72. Conventional feedback control methods may be used to control this operation by factoring in the variables associated with the mechanical movements of the gas pedal. The value transmitters 68 and 72 provide signals to microprocessor 74 which receives the information of the actual position of the throttle 10 via potentiometer 68, the desired position of the throttle 10 via a potentiometer 72, and further operational parameters of the engine, e.g. load, speed, etc. Furthermore, such microprocessor can receive other operational parameter information, e.g. whether there is any slip on the wheels.

OPERATION OF THE THROTTLE VALVE ASSEMBLY

In operation, the driver depresses the gas pedal which pulls the cable 20 downward in the direction of arrow 95. This, in turn, rotates the pivot unit shaft 60 (journaled in bearing 62 on fixed member 73) about its axis in the clockwise direction which causes lateral tang 66 to engage drive lever 22 at its stop-point 52. The setting unit 18, being affected by any clockwise movement of its drive lever 22, is also pivoted clockwise. To prevent a rotation of the drive lever 22 beyond the amount set by the pivot unit 61, which may result in a disengagement between the drive lever 22 and stop point 52 of lateral tang 66, the recoil spring 24 is provided with a sufficiently high return (counterclockwise) spring force.

The clockwise axial rotation of setting unit 18 is transferred to radial lever 16 of the throttle valve unit 5 via tang 30 and output lever 28 of setting unit 18. Spring 32 is provided to insure that radial lever 16 remains engaged with lateral tang 30, provided no additional forces affect the throttle valve 10. In this manner, the maximum opening angle of throttle valve 10 is specified, but the throttle valve 10 is still able to rotate in the counterclockwise direction (i.e., the closing direction), as long as the closing force (associated with the release of the gas pedal and the stronger restorative force of recoil spring 24) exceeds the spring constant of spring 32.

Closure of the throttle valve 10 between the maximum open position, as specified by the driver when stepping on the gas pedal (i.e., when cable 20 moves downward in direction of arrow 95), and the completely closed position is governed by the servomotor 42. The parameters to drive the servomotor 42 are determined by appropriately preset and stored parameters associated with efficient vehicle operation including but not limited to: engine speed, RPM, and gas pedal characteristics (e.g., angular settings, return spring characteristics and the like).

In addition, the throttle valve setting values (that is, the actual-value as determined from the actual-value transmitter 68 and the desired-value as determined from the desired-value transmitter 2) that result from the power output or requirements associated with gas pedal operation are other parameters that factor into the operation of the servomotor 42.

An important aspect of the present invention is the use of the stop adjuster 54 to prevent complete closure of the throttle valve due to its own mechanical presetting. Thus, even if the pivot unit 61 is rotated to its fully closed position (counterclockwise) in response to a total release of pressure on the pedal, the limit or stop screw 82 and stop adjuster bolt 56 prevent a complete resetting of the pivot unit 18 (that occurs due to recoil spring 24) back to the 0° position by restraining the full counterclockwise rotation of output lever 28. In other words, the stop adjuster 54 holds the setting unit 18 in a position that corresponds to an opening angle of about 10° of the throttle valve 10. The adjustment of the opening setting of the throttle valve between 0° and 10° range is controlled solely by the servomotor 42. Thus, the servomotor 42 is responsive to conditions relating control of idle fuel injection. It has been found that a servomotor used in this manner assures a constant idle RPM.

Since the apparatus associated with the setting unit 18 changes in response to mechanical gas pedal movements, the desired-value transmitter 72 is not held fixed, but rather assumes values ranging between 0° and 10° in response to changes in the power requirement. In this limited closure range the pivot unit 61 does not operate the setting unit 18. In other words, the power control of the internal combustion engine takes place solely by the desired-value transmitter 72 and the servomotor 42 in the closure range of 0°-10° of the throttle valve flap 10.

The lower value for the opening angle set by the stop adjuster 54 is selected so that the necessary play is available for idle fuel injection control. As described above, in case of a failure of the servomotor 42 or the desired-value transmitter 72, the power output from the internal combustion engine is held within a preset limit by means of a predetermined manual override setting. The manual override setting has a sufficient safety margin to prevent dangerous operating states, associated with sudden or uncontrolled accelerations.

An important area of application of the invention is in the damping of uncontrolled accelerations and power surges. Upon sudden depression of the gas pedal, the pivot unit 61 and setting unit 18 are rotated abruptly in the clockwise direction and thus the maximum opening angle is opened wider. The servomotor 42 compensates for this situation by controlling the actual opening of the throttle valve 10 after a time-offset (time-delay) preprogrammed into the microprocessor 74, in order to obtain a gentler response behavior that increases the ease of acceleration with no noticeable loss in power.

Another important area of application of this invention relates to the prevention of abrupt load change shock during rapid decelerations. For instance, during a sudden release of pressure on the gas pedal, the throttle valve 10 of this invention does not completely close. A minimum opening angle of 11° (for example) is guaranteed due to the limiting features of the stop adjuster 54. Therefore, in this type of situation, no abrupt load reversal shock occurs due to complete loss of power; that is, since throttle valve 10 stays partly open before closing slowly, the jolt from removal of pulling the load (the vehicle) by the engine is smoothed-out.

A speed control (cruise control) system may also be linked to the stop adjuster 54. In the present invention, the setting unit 18 is operated by the speed control system and specifies the maximum opening angle of the throttle valve 10. Since the stop point 52 of the lateral tang 66 of the adjusting lever 64 acts only on one side on the drive lever 22, the drive lever 22 is free to continue to move in the clockwise direction even after the pivot unit 60 has slowed down or stopped in response to the movement associated with the gas pedal. Accordingly, setting of the cruise speed then takes place via the solenoid 54, e.g. the driver setting a desired speed input signal to the microprocessor which controls the extension of bolt 56 of the solenoid 54 to set the angle of tang 30 at an appropriate throttle opening. The servo is also activated to rotate tang 38 to the set speed angle and the spring 32 causes valve flap 10 to follow and open to the preset speed. The lever 22 disengages from tang 64 and the gas pedal setting is not affected.

An advantage of the invention is that moving the throttle by the cruise control does not affect the rotation of hub 62 and therefor is not transferred to the accelerator pedal via the cable 20. The exact opening degree of the throttle 10 via cruise control is done by servo 42 and solenoid 54 (an additional feature of the microprocessor 74). Since the servo 42 is too weak to rotate against the spring 24 in the opening direction, the stop adjuster 54 is actuated to open the lever 50 to such a degree that the servo 42 is free to move the throttle without a contact between lever 90 and its corresponding stop 30.

Further, the solenoid 54 can be programmed by the microprocessor to have a stop position for emergency operation. For example, if there is a failure in the throttle system, low fuel or engine problem, the solenoid can set an emergency stop to enable the user to "limp home", for example under lean fuel conditions (dry running) where there may be non-optimum engine operation, or off-specification for $NO_x$ values in the exhaust gases and the like.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. Throttle valve assembly for an internal combustion engine having a throttle open and throttle closed positions, comprising in operative combination:

(a) a throttle valve unit having means for biasing a throttle valve toward said throttle open position;

(b) a setting unit having:

(i) first stop means for limiting the motion of the throttle valve toward said open position;

(ii) second stop means for limiting the motion of the first stop means toward said throttle closed position and determining a first partially open position;

(c) a pivot unit having:

(i) means for moving said first stop means toward said open position responsive to actuation of a gas pedal;

(d) means for controlling the degree of opening and closing of the throttle valve between said closed position and said partially open position determined by said second stop means limiting the motion of said first stop means; and (e) said degree of throttle opening means operating between said closed position and said partially open position independent of said gas pedal upon release of said gas pedal.

2. Throttle valve assembly as in claim 1 wherein:
(a) said degree of throttle opening means is a servomotor.

3. Throttle valve assembly as in claim 1 wherein:
(a) said second stop means is adjustable.

4. Throttle valve assembly as in claim 3 wherein:
(a) said adjustable second stop means is selected from a servomotor, a hydraulic pressure box, and a pneumatic pressure box.

5. A throttle valve assembly as in claim 1 wherein:
(a) said throttle valve unit includes an actual value transmitter for sensing the degree of opening of the throttle valve; and
(b) said pivot unit includes a desired value transmitter for sensing the degree of opening in response to actuation of said gas pedal.

6. A throttle valve assembly as in claim 5 which includes:
(a) a microprocessor which receives signals from said transmitters and selectively actuates at least one of said second stop means and said means for controlling the degree of opening of said throttle valve.

7. A throttle valve assembly as in claim 6 wherein:
(a) said degree of throttle opening means is a servomotor;
(b) said second stop means is adjustable;
(c) said adjustable second stop means is selected from a servomotor, a hydraulic pressure box, and a pneumatic pressure box; and
(d) said microprocessor is programmed to control both the rate and degree of closing by said servomotor, and upon sensing failure of said servomotor to control said throttle closing by adjusting said second stop position.

8. A throttle valve assembly as in claim 7 wherein:
(a) said adjustable stop means is selectively adjustable for start-up, dry running, normal operation, emergency operation, and cruise control speed settings.

9. A throttle valve assembly as in claim 2 wherein:
(a) said pivot unit is actuatable manually between 0° and 90°;
(b) said setting unit is actuatable between about 4° and 90°; and
(c) said servomotor controls the throttle valve between 0° and maximum opening.

10. A throttle valve assembly as in claim 9 wherein:
(a) said throttle valve unit includes an actual value transmitter for sensing the degree of opening of the throttle valve;
(b) said pivot unit includes a desired value transmitter for sensing the degree of opening in response to actuation of said gas pedal: and which includes:
(c) a microprocessor which receives signals from said transmitters and selectively actuates at least one of said second stop means and said means for controlling the degree of opening of said throttle valve;
(d) means for controlling idle fuel injection; and wherein:
(e) said servomotor receives opening control signals from said means for idle fuel injection control.

11. A throttle valve assembly as in claim 1 wherein:
(a) each of said throttle valve unit, said setting unit and said pivot unit includes an axial shaft;
(b) said shafts are co-axial and the ends of each are spaced from each other to permit independent rotation;
(c) said gas pedal is linked to said pivot unit;
(d) said pivot unit includes means for engaging said setting unit to rotate its shaft from said first partially open position to a more open position; and
(e) said setting unit includes means for engaging said throttle valve unit to rotate said throttle valve from an open position to said partially open position.

12. A throttle valve assembly as in claim 11 wherein:
(a) said pivot unit engaging means is spring biased against rotating actuation of said setting unit;
(b) said setting unit is spring biased to rotate said first stop means toward said second stop means; and
(c) said throttle valve is spring biased toward said open position.

13. A throttle valve assembly as in claim 12 wherein:
(a) said degree of throttle opening means is a servomotor;
(b) said second stop means is adjustable; and
(c) said adjustable second stop means is selected from a servomotor, a hydraulic pressure box, and a pneumatic pressure box.

14. A throttle valve assembly as in claim 13 wherein:
(a) said throttle valve unit includes an actual value transmitter for sensing the degree of opening of the throttle valve;
(b) said pivot unit includes a desired value transmitter for sensing the degree of opening in response to actuation of said gas pedal; and which includes:
(c) a microprocessor which receives signals from said transmitters and selectively actuates at least one of said second stop means and said means for controlling the degree of opening of said throttle valve.

15. A throttle valve assembly as in claim 14 wherein:
(a) said servomotor associated with said throttle opening means includes means for engaging said throttle valve shaft to rotate it towards a closed position.

16. A throttle valve assembly as in claim 15 wherein:
(a) said engagement means between each of said units comprises parallel opposed lever arms on the ends of said shafts and tangs from the driving arm on one shaft to the driven arm on the adjacent shaft.

17. Method of controlling throttle settings of an internal combustion engine comprising the steps in appropriate sequence of:
(a) providing mechanical control of throttle valve settings in the range of from about 4°–15° open to full open in response to manual gas pedal operation; and
(b) providing electronic control of closure and opening of said throttle valve from 0° to about 4°–15° open independent of said manually activated mechanical control, and upon release of and initiation of said manual operation.

18. Method as in claim 17 wherein:
(a) said electronic control includes timed delay of opening and closing of said throttle valve after initiation and release of said manual control.

19. Method as in claim 18 which includes the step of:
(a) adjusting the point of transfer between electronic and manual control in the range of from zero to about 15°.

20. Method as in claim 19 which includes the steps of:
(a) sensing failure of said electronic control; and wherein
(b) said adjustment step includes the step of adjusting said transfer point close to 0° upon sensing said failure.

* * * * *